US010443556B2

(12) United States Patent
Bianchi et al.

(10) Patent No.: US 10,443,556 B2
(45) Date of Patent: Oct. 15, 2019

(54) INJECTION SYSTEM FOR TWO-STROKE ENGINES

(71) Applicant: Betamotor S.P.A., Rignano sull'Arno (FI) (IT)

(72) Inventors: Lapo Bianchi, Florence (IT); Jacopo Fiaschi, Scandicci (IT); Paolo Trassi, Cerreto Guidi (IT); Federico Tozzi, Poggibonsi (IT)

(73) Assignee: Betamotor S.P.A., Rignano sull'Arno (FI) (IT)

( * ) Notice: Subject to any disclaimer, the term of this patent is extended or adjusted under 35 U.S.C. 154(b) by 33 days.

(21) Appl. No.: 15/547,799

(22) PCT Filed: Feb. 3, 2016

(86) PCT No.: PCT/IB2016/050544
§ 371 (c)(1),
(2) Date: Jul. 31, 2017

(87) PCT Pub. No.: WO2016/128861
PCT Pub. Date: Aug. 18, 2016

(65) Prior Publication Data

US 2018/0023528 A1 Jan. 25, 2018

(30) Foreign Application Priority Data

Feb. 11, 2015 (IT) ..... FI2015A0028

(51) Int. Cl.
*F02M 69/10* (2006.01)
*F02M 61/14* (2006.01)
(Continued)

(52) U.S. Cl.
CPC ..... *F02M 69/10* (2013.01); *F02M 61/145* (2013.01); *F02M 69/042* (2013.01);
(Continued)

(58) Field of Classification Search
CPC .... F02M 69/10; F02M 69/042; F02M 61/145; F02M 25/06; F02B 75/02; F02B 5/00; F02B 2075/025; F02B 25/14
See application file for complete search history.

(56) References Cited

U.S. PATENT DOCUMENTS 3,687,118 A 8/1972 Nomura
5,249,557 A * 10/1993 Katoh ..... F01L 3/205 123/305

(Continued)

FOREIGN PATENT DOCUMENTS

EP 0943788 A1 9/1999
FR 2669377 A1 5/1992

(Continued)

OTHER PUBLICATIONS

Int'l Search Report and Written Opinion, PCT/IB2016/050544, dated May 24, 2016.

*Primary Examiner* — Jacob M Amick
*Assistant Examiner* — Charles Brauch
(74) *Attorney, Agent, or Firm* — Nancy J. Flint, Attorney at Law, P.A.; Nancy J. Flint, Esq.

(57) ABSTRACT

An electronic injection two-stroke endothermic engine comprising an upper fuel injector (13) and a lower fuel injector (14), both accommodated in an intake duct (12) directly facing the cylinder (1), the latter closed by a head to form a combustion chamber (6) with one or more spark plugs (5) and connected to a pump-crankcase underneath via a plurality of side transfer ports (7, 8) which a central transfer port (15) is added to and crosses said intake duct (12) and allows the fuel sprayed by said lower injector (14) to reach the inside of the cylinder (1).

20 Claims, 3 Drawing Sheets

(51) Int. Cl.

| | |
|---|---|
| ***F02M 69/04*** | (2006.01) |
| ***F02B 25/14*** | (2006.01) |
| ***F02B 5/00*** | (2006.01) |
| ***F02B 75/02*** | (2006.01) |
| ***F02M 25/06*** | (2016.01) |

(52) U.S. Cl.
CPC ..... *F02B 5/00* (2013.01); *F02B 25/14* (2013.01); *F02B 75/02* (2013.01); *F02B 2075/025* (2013.01); *F02M 25/06* (2013.01)

(56) References Cited

U.S. PATENT DOCUMENTS

| | | | | |
|---|---|---|---|---|
| 5,806,473 | A * | 9/1998 | Kometani | F01N 13/12 123/299 |
| 2006/0272600 | A1* | 12/2006 | Tsutsui | F02B 25/14 123/73 PP |
| 2010/0014992 | A1* | 1/2010 | Di Foggia | F01B 9/026 417/254 |
| 2011/0220059 | A1 | 9/2011 | Ganglmayr | |
| 2014/0202428 | A1* | 7/2014 | Mavinahally | F02M 37/00 123/434 |

FOREIGN PATENT DOCUMENTS

| | | | |
|---|---|---|---|
| WO | 9322545 | A1 | 11/1993 |
| WO | 2004106714 | A1 | 12/2004 |
| WO | 2006007614 | A1 | 1/2006 |

* cited by examiner

INJECTION SYSTEM FOR TWO-STROKE ENGINES

TECHNICAL FIELD

The present invention refers to the field of two-stroke endothermic engines, of the fuel injection and spark controlled-ignition type, typically used for light vehicles, including motorcycles, scooters, or 4-wheel motorbikes, or even for use in water or for motorizing vehicles or gardening equipment.

Specifically, the invention belongs to the field of engines equipped with low-pressure injectors and is particularly advantageous in the case of injectors that simultaneously inject fuel and lubricant.

PRESENT STATUS OF THE ART

In principle, it is known that fuel-injection two-stroke endothermic engines are controlled-ignition engines, wherein air is directly carbureted in the cylinders or before the suction valves, by way of intermittent jets of gasoline produced by injectors.

When injection is made directly in the cylinder, a good washing of the cylinder and of the combustion chamber can be made by way of air, hence without waste of fuel and with a considerable reduction in noxious emissions; it is also possible to realize a fuel dosing more accurate than with a carburetor at any number of revolutions and during transients.

However, in injection two-stroke engines it is more difficult to obtain a homogeneous mixture of fuel with comburent air, because fuel has a shorter period of time at its disposal to mix with air; it has been attempted to reduce this disadvantage by creating a strong swirl to improve combustion.

An improved combustion is essential to reduce emissions of polluting substances, i.e. mainly unburnt hydrocarbons and carbon and nitrogen oxides.

Another cause of pollution consists of the mixing of lubricant with fuel, whereby the percentage of unburnt fuel is also impaired by the presence of residues of lubricant, because in two-stroke engines lubrication is usually performed by using lubricant-added fuel.

In order to obviate these drawbacks, direct gasoline injection two-stroke engines have been set-up. In particular, let's remember WO 2004/106714 A1, which illustrates a two-stroke engine with an injector inserted in the cylinder according to such an angle as to spray gasoline toward the head of the engine in an instant when the piston just closed the air inlet ports; in these conditions pressure is still low in the combustion chamber and a high-pressure injector is not necessary to overcome it.

However, this system presents a number of drawbacks, mainly because of the limited quantity of fuel that can be injected by one injector only.

This drawback also affects WO 2006/007614 A1, wherein, on the other hand, air is not injected into the cylinder, but rather into the pump-crankcase.

It is generally not recommended to increase the injector opening time, on the contrary, in order to minimize the risk of a fresh mixture leakage, it is rather advisable to end injection after closing the exhaust port; this is the reason why particularly powerful two-stroke engines provided with two injectors per cylinder have been developed for a long time, as shown in WO 9322545 A1 or in US 2011/0220059 A1.

The latter patent application explains that if the injectors are arranged in the cylinder symmetrically with respect to the exhaust port, the axes intersecting the longitudinal axis (X) of the cylinder, symmetry conditions are achieved which foster the distribution of fuel in the combustion chamber whenever the engine runs at high numbers of revolutions and both injectors are active, whereas such favorable conditions do not exist in correspondence with low numbers of revolutions when one injector only operates. Furthermore, this configuration implies that the injected streams meet in the middle zone of the cylinder, thus developing a significant component of speed directed toward the exhaust port, with a consequent emission of considerable quantities of unburnt hydrocarbons.

Conversely, if the injectors are not arranged symmetrically, then the ideal conditions could not be achieved when the engine runs at the highest numbers of revolutions, but only at the lowest ones. Therefore US 2011/0220059 A1 teaches to arrange the injectors in such a way that their axis reciprocally intersect on that side of the axis of the cylinder which faces the exhaust port and extend toward the transfer ports located on the opposite sides of the diametral plane respectively.

This solution presents a number of important criticalities: first of all it makes it necessary to equip the engine with a separate lubrication circuit, for instance by way of an electric pump, to properly lubricate the crank-gear accommodated in the pump-crankcase, because the lubricant alone added to fuel would always remain inside the cylinder.

Furthermore, the stream of fuel unavoidably concentrates on the crown of the piston, this way increasing noxious emissions of unburnt hydrocarbons; on the other hand, the construction of the piston shall include appropriate slots to make it possible for fuel to pass through, a solution that is particularly expensive.

OBJECTS AND SUMMARY OF THE INVENTION

An object of the device according to the present patent application is thus to provide a two-stroke endothermic engine, of the controlled-ignition type, that is capable of reducing noxious emissions and consumption, while simultaneously improving performances and guaranteeing a high specific power.

These objects of the present invention and others are achieved by means of an engine comprising at least one cylinder which is put in contact with the external world via an intake duct wherein two injectors are accommodated downstream the lamellar pack; the cylinder is closed by a head with at least one spark plug on the upper side and is closed by a pump-crankcase on the lower side, which accommodates the crank-gears and is connected to the cylinder via side transfer ports; said intake duct is also crossed by a further transfer port, called central transfer port, so that the upper injector sprays fuel in the duct and orients it toward the axis of the cylinder and downwards, whereas the lower injector sprays fuel toward the axis of the cylinder and upwards, whereby it is directed toward the cylinder after first crossing the intake duct and subsequently covering the upper section of the central transfer port.

The exhausted gases are finally ejected from the cylinder via an exhaust duct.

For the reasons explained above, the aim is to delay fuel injection as much as possible, compatibly with transfer port timing, so as to perform the first part of washing with air only or with a very lean mixture. As power demand increases, both injectors operate. The upper injector warranties a good mixing, as necessary to get high power values.

In a practical embodiment of the invention, fuel is a gasoline, which an appropriate quantity of lubricant has been added to, so as to eliminate the need for a dedicated lubricant tank and for pumps for its transfer.

Advantageously the system used to control the injector of the engine according to the present patent application is of a type comprising at least one electronic control unit, so that the injectors can be operated individually independently of each other.

According to a typical operating sequence, whenever the engine runs at a low number of revolutions and at a low load, the lower injector is operated in such a way as to end fuel injection well in advance with respect to the closing of the transfer port by the piston; this way the lower injector transfers most of the necessary quantity of fuel, whereas the upper injector is only operated with the purpose of guaranteeing the minimum flow rate necessary for lubricating the crank-gears in the pump-crankcase.

The lower injector is positioned in such a way that the fuel jet that comes out therefrom perfectly follows the air stream that in that moment, during the descending stroke of the piston, is going up along the central transfer port and is directed toward the electrode of the spark plug.

In this way the first part of the washing will take place with a very lean mixture of air and fuel, i.e. with few fuel, thus allowing to considerably reduce fuel losses upon exhaust.

As power demand increases, the quantity of fuel transferred by the lower injector increases, up to reaching a condition wherein the latter is not capable any longer of meeting a further request for fuel; therefore, the quota of fuel injected by the upper injector will progressively increase. Then the fuel injected by the upper injector goes down into the pump-crankcase wherefrom it will transfer into the combustion chamber via the transfer ports, during the subsequent descent of the piston toward the lower dead point; this process caters for a good air-fuel homogenization as necessary to generate the maximum power values available.

Figure 1:
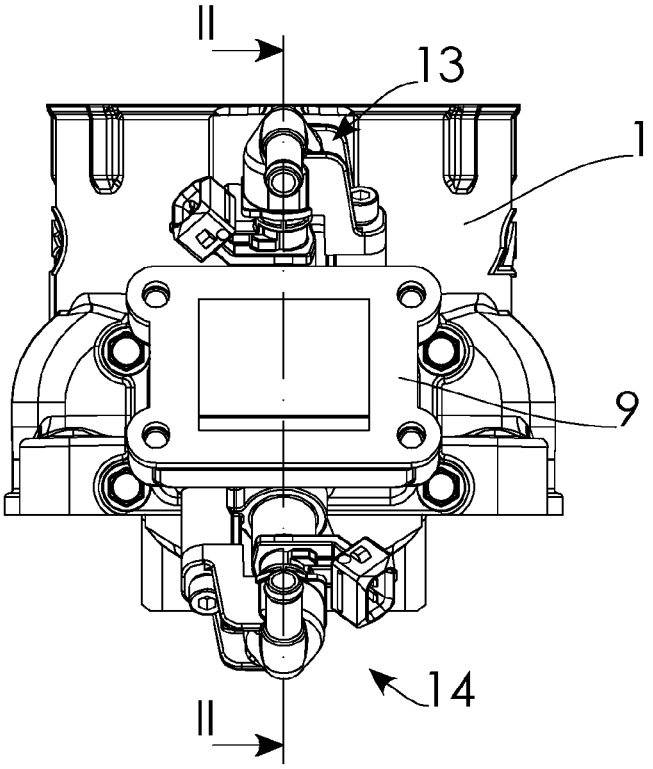
FIG. 1 shows a rear view of the cylinder of the endothermic engine according to the present patent application in an embodiment wherein the suction channel presents a first part integral with the cylinder (1) and a second part consisting of a stand-alone element, the latter comprising seats for an upper injector (13), a lower injector (14), and for a lamellar pack (9). The view also shows the trace of the cutting plane of the cross-section shown in the following figure.
Figure 2:
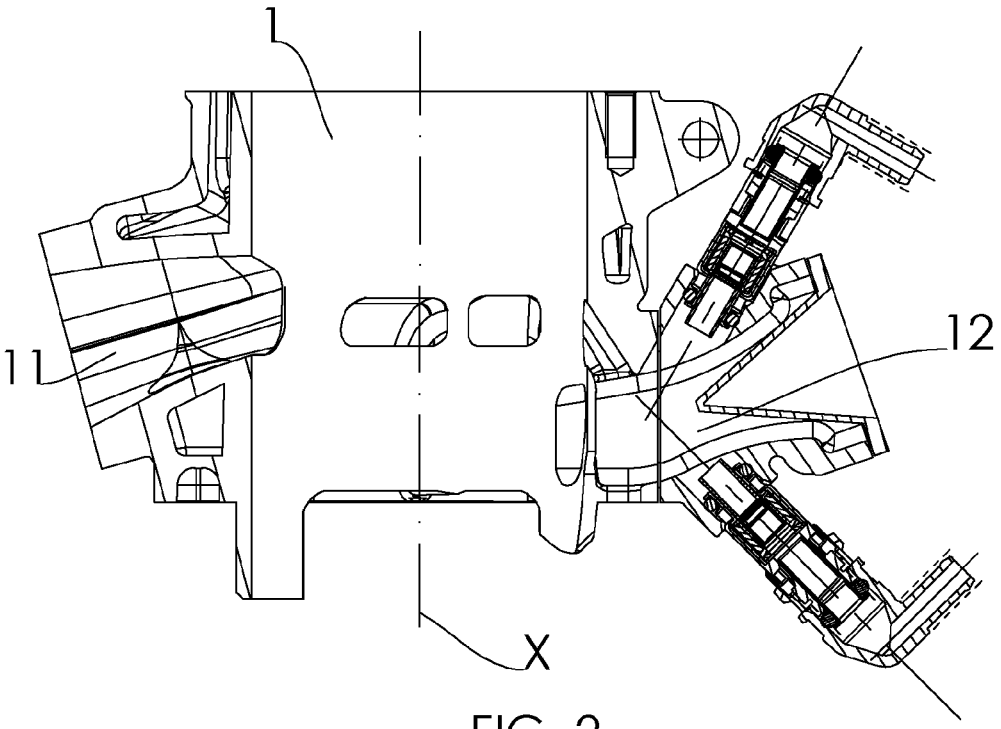
FIG. 2 shows a cross-section view wherein it is possible to look at inside the cylinder (1), with its respective longitudinal axis (X), connected to the external world via an intake duct (12) and an exhaust duct (11).

The figure shows the cylinder (1), which presents an exhaust duct (11), side transfer ports (7, 8), and a central transfer port (15). The upper inner part of said cylinder, closed by the head (3) which comprises a seat for a spark plug (5), operates as a combustion chamber (6).

The figure shows an embodiment whereby the intake duct (12) is split into two parts, a former part being integral with the cylinder (1) and comprising an intersection with the central transfer port (15), and a second part, on the right-hand side of the drawing, wherein seats for the accommodation of the upper injector (13) and of the lower injector (14) are obtained, as well as a seat for the lamellar pack (9).

In the side walls of the cylinder (1) the ducts for the engine cooling thermal vector fluid, typically an aqueous mixture, are visible.

A crank-gear (4) is housed inside a pump-crankcase, the latter not being shown.

The figure also shows the longitudinal axis (X) of the cylinder and the longitudinal axis (B) of the lower injector which, in proximity of the lower dead point, reaches the combustion chamber with no intersection at all, by transversally crossing the intake duct (12) and subsequently entering the upper section of the central transfer port (15).

Figure 3:
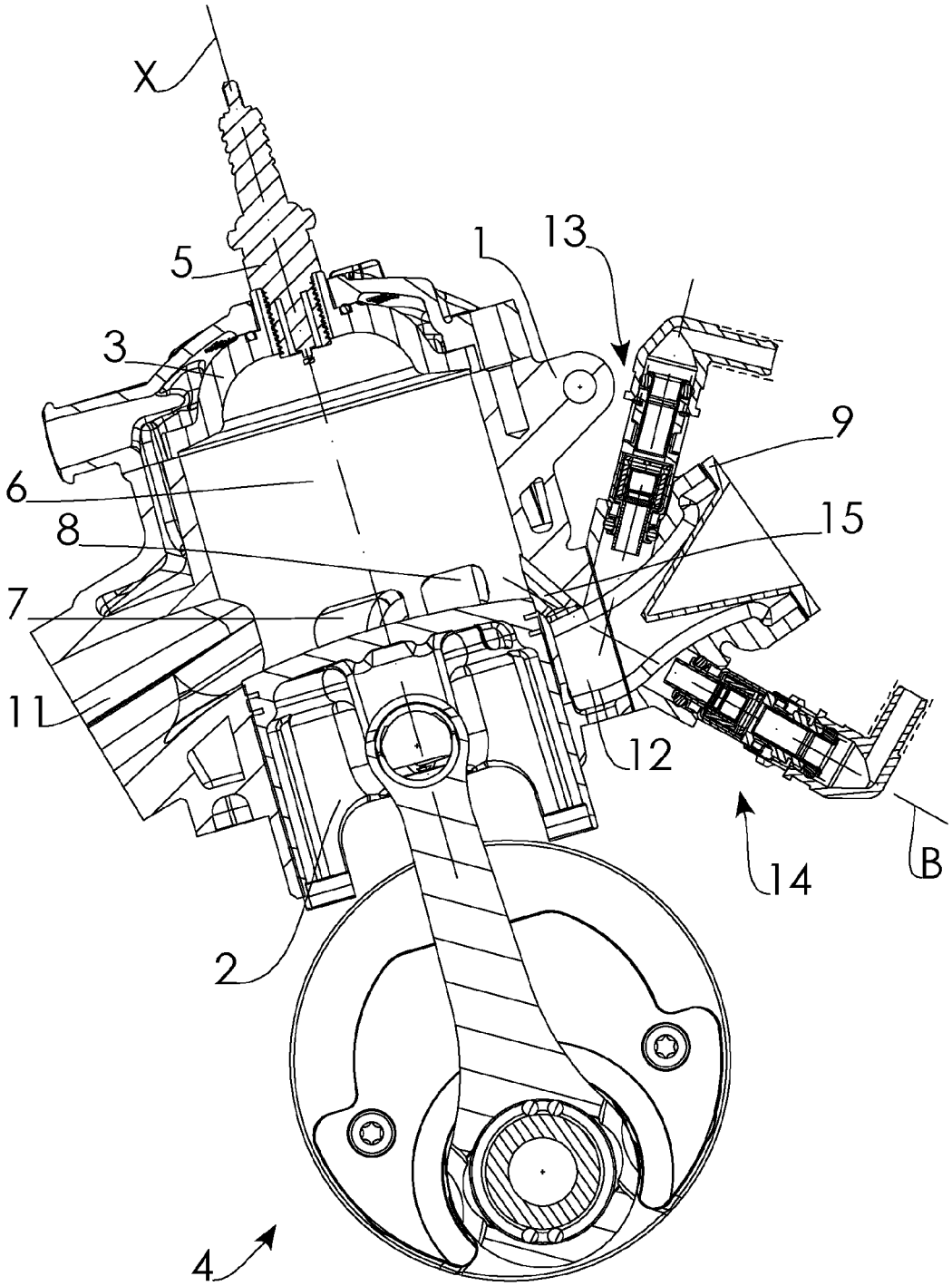
FIG. 3 shows a cross-sectional view of an embodiment of the endothermic engine according to the present patent application which allows to look at the peculiar features of the invention; the piston is shown in its lower dead point.
Figure 4:
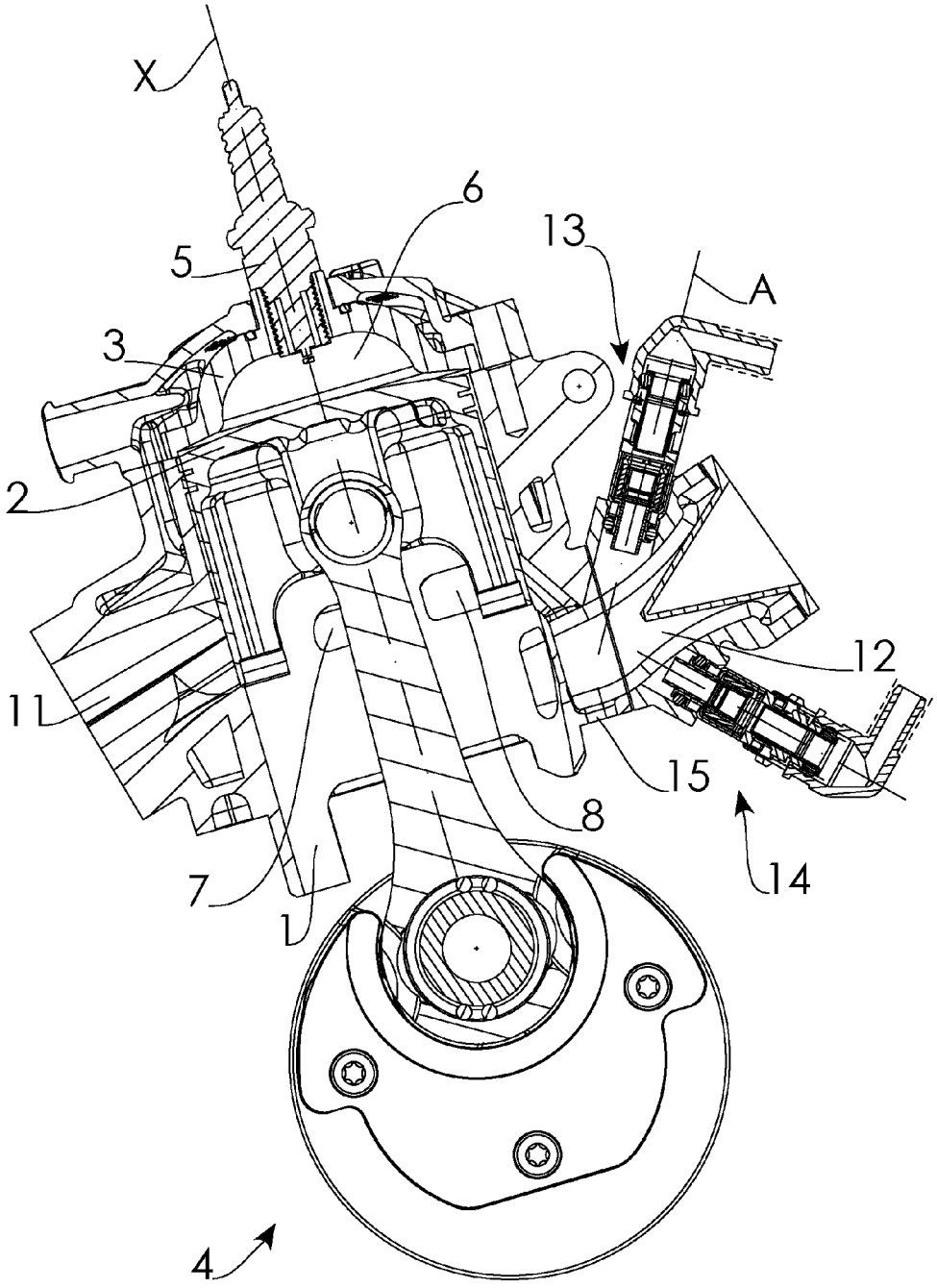

FIG. 4 shows a cross-sectional view of the embodiment shown in FIG. 3, the piston being at the upper dead point. With respect to the references of the previous figure, the drawing shows the longitudinal axis (A) of the upper injector and the lower section of the central transfer port (15) placed between the intake duct (12) and the pump-crankcase.

DETAILED DESCRIPTION OF AN EMBODIMENT OF THE INVENTION

The following detailed description, which is made for explanatory not limitative purposes with reference to the attached drawings, highlights the further features and advantages deriving therefrom and which are an integral part of the subject invention.

In a particularly compact and economical embodiment, the controlled ignition two-stroke endothermic engine according to the present patent application comprises at least one cylinder (1), featuring a substantially circular cross-section, which slidingly accommodates internally thereto a substantially cylindrical piston (2), and is connected on the top side to a head (3) in such a way as to define a combustion chamber (6) with at least one spark plug (5).

The cylinder (1) is connected on the bottom side to a pump-crankcase, the latter communicating with said cylinder (1) by way of at least one central transfer port (15) and, usually, also by way of one or several side transfer ports (7, 8); the cylinder (1) also includes an exhaust duct (11) and an intake duct (12), the latter accommodates an upper fuel injector (13) and a lower fuel injector (14).

The two injectors may have different characteristics and their operation is controlled independently by an appropriate drive and control system which, advantageously, is controlled electronically.

Furthermore, in proximity of the wall of the cylinder (1), the intake duct (12) is crossed by a further transfer port (15) called central transfer port.

The upper injector (13) is accommodated in the higher part of the intake duct (12) and the speed of the fuel sprayed by it has both a component parallel to the axis (X) of the cylinder (1) directed toward the pump-crankcase, and a component orthogonal to the central axis of said cylinder (1) directed toward the inside of the cylinder (1).

The lower injector (14) is housed in the lower part or said intake duct (12) so that the fuel sprayed by it reaches the inside of said cylinder (1) after first crossing said intake duct (12) and subsequently going along the upper section of said central transfer port (15).

In a particularly simple and practical embodiment the outer end of said intake duct (12) includes a seat for mounting the lamellar pack (9) thereon.

Advantageously said intake duct (12), in which seats are obtained for housing said upper injector (13) and said lower injector (14), is aligned with the suction port obtained on said cylinder (1) which it is integrally coupled with.

In a convenient embodiment the intake duct (12) is diametrically opposed to the exhaust duct (11).

The intake duct (12) can be completely obtained in a part of the cylinder (1), or be split into two or more parts, a first part of which is integral with the cylinder (1) and a second part consists of a stand-alone element, integrally connected to the cylinder (1) via coupling means of a known type.

In the embodiment illustrated in the drawings attached to the present patent application, the part integral with the cylinder (1) comprises a section wherein the intake duct (12) crosses the central transfer port (15), whereas the part consisting of a stand-alone element comprises the seat for the injectors (13, 14) and the lamellar pack (9), thus forming a stand-alone sub-assembly which can also be used on different cylinders, provided the latter have all presettings necessary for coupling with said sub-assembly.

The invention claimed is:

1. A controlled ignition two-stroke endothermic engine, comprising at least one cylinder whose interior slidingly houses a piston, wherein the at least one cylinder is connected to a head on its upper side so as to define a combustion chamber, the head comprising at least one spark plug, wherein the at least one cylinder is connected to a pump-crankcase on its lower side, wherein the pump-crankcase is in communication with the at least one cylinder at least via a central transfer port, wherein the at least one cylinder is in direct communication with the external world via an exhaust duct and an intake duct, wherein the intake duct is crossed by the central transfer port, wherein further the intake duct houses on its top side an upper fuel injector and houses on its bottom side a lower fuel injector, wherein the lower fuel injector is oriented so that fuel sprayed from it reaches the inside of the at least one cylinder after first having crossed the intake duct and subsequently running the upper part of the central transfer port which connects the intake duct with said cylinder, wherein air pressure of air introduced into the at least one cylinder from the intake duct does not exceed the pressure of the external world.

2. The engine of claim 1, wherein the at least one cylinder further communicates with the pump-crankcase via at least one side transfer port.

3. The engine of claim 2, wherein the speed of the fuel sprayed by the upper fuel injector comprises a component parallel to the axis of the at least one cylinder directed toward the pump-crankcase and a component orthogonal to the central axis of the at least one cylinder directed toward the inside of the cylinder.

4. The engine according to claim 3, wherein the central transfer port crosses the part of the intake duct between the upper fuel injector and the lower fuel injector and the at least one cylinder.

5. The engine of claim 4, wherein the lower fuel injector is housed in the lower part of the intake duct so that the axis according to which it sprays the fuel crosses the central transfer port up to reaching the inside of the at least one cylinder.

6. The engine of claim 5, wherein the intake duct is subdivided into two or several parts, of which a first part is integral with the at least one cylinder and a second part comprises a separate element, integrally connected to the at least one cylinder through coupling means, wherein the second part forms a stand-alone sub-assembly.

7. The engine of claim 6, wherein the central transfer port intersects the first part of the intake duct and wherein the second part of the intake duct comprises seats for the upper fuel injector, the lower fuel injector and a lamellar pack.

8. The engine of claim 7, wherein the central transfer port is directed toward the electrode of the spark plug.

9. The engine of claim 1, wherein the speed of the fuel sprayed by the upper fuel injector comprises a component parallel to the axis of the at least one cylinder directed toward the pump-crankcase and a component orthogonal to the central axis of the at least one cylinder directed toward the inside of the at least one cylinder.

10. The engine according to claim 9, wherein the central transfer port crosses the part of the intake duct between the upper fuel injector and the lower fuel injector and the at least one cylinder.

11. The engine of claim 10, wherein the lower fuel injector is housed in the lower part of the intake duct so that the axis according to which it sprays the fuel crosses the central transfer port and reaches up to the inside of the at least one cylinder.

12. The engine of claim 11, wherein the intake duct is subdivided into two or several parts, of which a first part is integral with the at least one cylinder and a second part comprises a separate element, integrally connected to the at least one cylinder through coupling means, wherein the second part forms a stand-alone sub-assembly.

13. The engine of claim 12, wherein the central transfer port is directed toward the electrode of the spark plug.

14. The engine of claim 1, wherein the intake duct is subdivided into two or several parts, of which a first part is integral with the at least one cylinder and a second part comprises a separate element, integrally connected to the at least one cylinder through coupling means, wherein the second part forms a stand-alone sub-assembly.

15. The engine of claim 14, wherein the central transfer port intersects the first part of the intake duct and wherein the second part of the intake duct comprises seats for the upper fuel injector, the lower fuel injector and a lamellar pack.

16. The engine of claim 1, wherein the central transfer port is directed toward the electrode of said spark plug.

17. The engine of claim 1, wherein the lower fuel injector is housed in the lower part of the intake duct so that the axis according to which it sprays the fuel crosses the central transfer port and reaches up to the inside of the at least one cylinder.

18. The engine according to claim 1, wherein the central transfer port crosses the part of the intake duct between the upper fuel injector and the lower fuel injector and the at least one cylinder.

19. A method for operating a two-stroke engine realized according to claim 1, wherein whenever the power demand of the engine is low the lower injector is operated in such a way as to end fuel injection before the central transfer port is closed by the piston, by injecting the fuel into the air stream that during the descending stroke of the piston is flowing up along the central transfer port, and in that the upper injector is operated just at the minimum rate necessary to lubricate a crank-gear located in the pump-crankcase.

20. The method of claim 19, wherein as the power demand of the engine increases, the amount of fuel transferred by the lower injector increases up to its maximum capacity, wherein afterwards the upper injector progressively increases its own delivery of fuel which goes down into the pump-crankcase from which, during the next descent of said piston, fuel will enter the combustion chamber through one of the transfer ports.

* * * * *